US007213993B2

(12) United States Patent
Takahashi et al.

(10) Patent No.: US 7,213,993 B2
(45) Date of Patent: May 8, 2007

(54) THERMALLY ACTIVATING DEVICE AND PRINTER APPARATUS

(75) Inventors: Masanori Takahashi, Chiba (JP); Minoru Hoshino, Chiba (JP); Yoshinori Sato, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 11/054,502

(22) Filed: Feb. 9, 2005

(65) Prior Publication Data

US 2005/0191109 A1 Sep. 1, 2005

(30) Foreign Application Priority Data

Feb. 26, 2004 (JP) ..... 2004-050987

(51) Int. Cl.
*B41J 11/00* (2006.01)

(52) U.S. Cl. ..... 400/619; 347/175

(58) Field of Classification Search ..... 375/175; 400/120.1; *B41J 002/315*
See application file for complete search history.

(56) References Cited

U.S. PATENT DOCUMENTS 5,115,322 A * 5/1992 Jang ..... 358/304
5,724,085 A * 3/1998 Inui et al. ..... 347/175
5,847,742 A * 12/1998 Nishimura ..... 347/173
6,037,961 A * 3/2000 Saito et al. ..... 347/185
6,533,477 B2 * 3/2003 Fukuda ..... 400/120.1
6,867,792 B2 * 3/2005 Hoshino et al. ..... 347/218
2003/0189631 A1 10/2003 Minoru et al.
2004/0257428 A1 * 12/2004 Sato et al. ..... 347/220

FOREIGN PATENT DOCUMENTS

EP 0788972 8/1997
EP 1006052 6/2000
EP 1356948 10/2003
EP 1388421 2/2004
JP 2001048139 A * 2/2001

* cited by examiner

*Primary Examiner*—Ren Yan
*Assistant Examiner*—Matthew Marini
(74) *Attorney, Agent, or Firm*—Adams & Wilks

(57) ABSTRACT

A thermally activating device has a pair of conveyor rollers which convey a heat-sensitive adhesive sheet while sandwiching the sheet therebetween, and a guide member provided at an anterior stage of the conveyor rollers for abutting on one surface of the heat-sensitive adhesive sheet to guide a path of the heat-sensitive adhesive sheet. A guide tip end nearest the conveyor rollers on a guide surface of the guide member is configured to be placed at a position displaced from a reference line in a direction opposite to a side toward which the heat-sensitive adhesive sheet bends, the reference line being a tangential line of the conveyor rollers and passing through a contact point of the pair of conveyor rollers. The guide surface of the guide member is configured to be inclined so that a distance between the guide surface and the reference line is shortened as the guide surface approaches the conveyor rollers.

9 Claims, 4 Drawing Sheets

THERMALLY ACTIVATING DEVICE AND PRINTER APPARATUS

BACKGROUND OF THE INVENTION

1. Field of the Invention

This invention relates to a thermally activating device which performs thermal activation of a heat-sensitive adhesive sheet, and to a printer apparatus which performs printing on such a sheet.

2. Description of the Related Art

A heat-sensitive adhesive label is expected to be utilized as a label pasted on a product produced/marketed in a food factory or a supermarket for displaying, for example, a trade name, a price, a use-by date and the like. The heat-sensitive adhesive label has an adhesive layer which does not have an adhesive force in a normal state. This adhesive layer is activated by application of heat energy to this adhesive layer, and thus is set capable of being pasted on an object. Including such a heat-sensitive adhesive label, a sheet having a similar adhesive layer is referred to in general as a heat-sensitive adhesive sheet in this specification.

Heretofore, as a thermally activating device which activates such a heat-sensitive adhesive label, one has been developed, which heats up the heat-sensitive adhesive label by a thermal head on which a large number of heat generating elements are formed, and thus activates the adhesive layer thereof.

Usually, such a thermally activating device constitutes a printer apparatus having a thermal activation function by being combined with a printing mechanism which performs printing on a printing surface of the heat-sensitive adhesive label, and with a cutting mechanism which cuts a continuous heat-sensitive adhesive sheet wound in a roll shape into a predetermined length. In such a printer apparatus, usually, the cutting mechanism is installed at a posterior stage of the printing mechanism, and the thermally activating device is installed at a posterior stage of the cutting mechanism.

Moreover, the applicant of this invention has previously described an invention, in which, when the heat-sensitive adhesive label is carried from the cutting mechanism to a thermally activating mechanism, a carrying-out speed of the cutting mechanism and a carry-in speed of the thermally activating mechanism are differentiated, and thus the heat-sensitive adhesive sheet is bent between a carrying-out portion of the cutting mechanism and an insertion portion of the thermally activating mechanism so as to swell toward one surface side, and is then carried to the thermally activating mechanism (Patent Document 1).

By bending the heat-sensitive adhesive sheet between the two mechanisms in such a manner, obtained is an effect that the heat-sensitive adhesive sheet can be temporarily stopped and subjected to the cutting process in a region of the cutting mechanism while the heat-sensitive adhesive sheet is subjected to the thermal activation process while being moved at a required speed without being stopped in a region of the thermally activating mechanism.

However, in the case of using the cutting mechanism and the thermally activating mechanism in combination as described above, a so-called jam sometimes occurs, in which the heat-sensitive adhesive sheet carried out of the cutting mechanism is not inserted properly into the insertion portion of the thermally activating mechanism, and jams at that portion.

It has been found that, in particular, in the case of adopting a configuration so as to bend the sheet between the cutting mechanism and the thermally activating mechanism as described in Patent Document 1, the jam occurs at an unignorable frequency if no contrivance is made because it is possible for the sheet to swell and escape toward the one surface side.

It is required that the thermal activation process be performed after cutting the sheet, and accordingly, cut ends of the heat-sensitive adhesive sheet are inserted into the thermally activating mechanism every time. Therefore, a jam occurrence rate of the sheet ends in the thermally activating mechanism directly appears as an error occurrence rate of the printer apparatus. Hence, it is very important to lower the jam occurrence rate of this portion.

An object of this invention is to lower a jam occurrence frequency in a mechanism which allows entries of leading ends of the carried heat-sensitive adhesive sheet and curled sheet, and convey the sheets.

SUMMARY OF THE INVENTION

In order to solve the above problems, according to the present invention, there is provided a thermally activating device, including a carrying-in section into which a heat-sensitive adhesive sheet is carried from a device at an anterior stage; and a heater section for heating the carried heat-sensitive adhesive sheet while conveying the heat-sensitive adhesive sheet, the thermally activating device being adapted to bend the heat-sensitive sheet toward one surface side between the carrying-in section and the device at an anterior stage by changing between a speed at which the heat-sensitive adhesive sheet is carried out of the device at the anterior stage and a carrying-in speed thereof in the carrying-in section, in which the carrying-in section includes a pair of conveyor rollers that convey the heat-sensitive adhesive sheet while sandwiching the heat-sensitive adhesive sheet therebetween; and a guide member which is provided at an anterior stage of the pair of conveyor rollers, and abuts on one surface of the heat-sensitive adhesive sheet to guide a path of the heat-sensitive adhesive sheet, and in which a guide tip end nearest the conveyor rollers on a guide surface of the guide member is placed at a position displaced from a reference line in a direction opposite to a side toward which the heat-sensitive adhesive sheet bends and swells when viewed from a rotation axis direction of the conveyor rollers, the reference line being a tangential line of the conveyor rollers and passing through a contact point of the pair of conveyor rollers Further, in order to solve the above problems, according to the present invention, there is provided a printer apparatus, including conveying means for conveying a sheet which is drawn from roll paper and curled in a fixed orientation; and a printing mechanism which has a line thermal head and performs printing on the sheet by the line thermal head, in which the conveying means includes a pair of conveyor rollers that convey the sheet while sandwiching the sheet therebetween; and a guide member which is provided at an anterior stage of the pair of conveyor rollers, and abuts on one surface fo the sheet to guide a path of the sheet, and in which a guide tip end nearest the conveyor rollers on a guide surface of the guide member is placed at a position displaced from a reference line in a direction opposite to a side toward which the sheet swells owing to the curling (in a direction in which a leading end of the sheet bends before the conveyor rollers owing to the curling) when viewed from a rotation axis direction of the conveyor rollers, the reference line being a tangential line of the conveyor rollers and passing through a contact point of the pair of conveyor rollers.

It is conceived that the jam before the pair of conveyor rollers occurs because a curled surface slightly before the leading end of the sheet abuts on one of the conveyor rollers before the leading end of the sheet enters between the conveyor rollers, and hinders the leading end of the sheet from going ahead. Accordingly, the position of the guide tip end is offset as described above. Thus, a possibility that the curled surface slightly before the leading end of the sheet abuts on the one of the conveyor rollers before the leading end of the sheet enters between the conveyor rollers is lowered. Alternatively, even if the curled surface abuts on the one conveyor roller, an influence thereof can be reduced. As a result, the leading end of the sheet smoothly enters between the pair of conveyor rollers.

It is preferable that the guide surface of the guide member be inclined so that a distance between the guide surface and the reference line is shortened in a part nearer the conveyor rollers.

The guide surface is inclined in such a manner. Thus, even if the curled surface slightly before the leading end of the sheet first abuts on the one conveyor roller, an angle of such abutment becomes an angle approximate to an advancing direction of the sheet. Therefore, a force to hinder the leading end of the sheet from advancing is decreased. As a result, the leading end of the sheet is made to smoothly enter between the pair of conveyor rollers.

Specifically, it is preferable that the guide tip end be displaced from the reference line by a length of R×0.05 to R×0.3, where R is a diameter of the conveyor roller on a side to which the guide tip end is displaced, of the pair of conveyor rollers; that an inclination at a portion of the guide tip end of the guide surface be set as 0° to 25° (more preferably 5° to 17°) with respect to the reference line; and that the guide tip end be placed at a position apart by R×0.25 to R×1.25 (more preferably R×0.25 to R×0.75) from a plane including respective rotation axis lines of the pair of conveyor rollers.

According to the present invention, in comparison with the case where the guide tip end of the guide member is set at the same height as the above-described reference line and the case where the guide surface is set parallel to the above-described reference line, the leading ends of the heat-sensitive adhesive sheet and curled sheet can be made to surely enter between the pair of conveyor rollers, and the jam occurrence frequency can be significantly lowered.

BRIEF DESCRIPTION OF THE DRAWINGS

For a better understanding of the present invention, reference is made to the following detailed description to be read in conjunction with the accompanying drawings, in which.

DETAILED DESCRIPTION OF THE PREFERRED EMBODIMENT

An embodiment of the present invention is described below based on the drawings.

Figure 1:
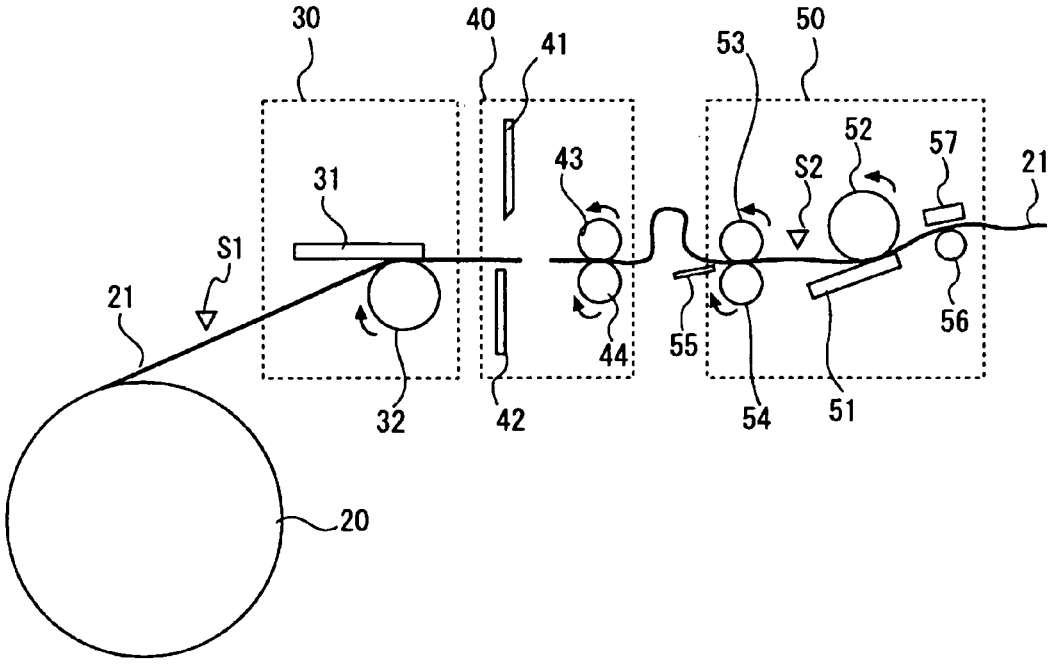
FIG. 1 is a schematic view showing a configuration of a printer apparatus according to an embodiment of the present invention.

FIG. 1 shows an entire configuration of a printer apparatus according to one embodiment of the present invention.

The printer apparatus of this embodiment is an apparatus which performs printing on a printing surface (heat-sensitive printable layer of a heat-sensitive adhesive sheet 21), cutting of the sheet 21 into a predetermined length, and thermal activation of a heat-sensitive adhesive layer of the sheet 21, and then discharges the sheet 21. The sheet 21 is composed by forming the printing layer on one surface of a sheet base material and the adhesive layer on the other surface. This printer is composed of a printing unit 30 which performs printing on the heat-sensitive adhesive sheet 21 while sandwiching the sheet 21 between a line thermal head 31 and a platen 32, a cutting unit 40 which cuts the continuous heat-sensitive adhesive sheet 21 by pinching the sheet 21 with, for example, a pair of blades 41 and 42, and a thermally activating unit 50 which heats up and activates the adhesive layer of the sheet 21.

The heat-sensitive adhesive sheet 21 is housed in a container of the printer apparatus in a rolled state as roll paper 20. The heat-sensitive adhesive sheet 21 needs to be discharged to the outside of the apparatus with the printing surface facing up. Accordingly, the thermal head 31 of the printing unit 30 is provided on an upper side of the sheet 21, and the platen roller 32 is provided on a lower side. On the contrary, in the thermally activating unit 50, a platen roller 52 is provided on the upper side, and a thermal head 51 which heats up the adhesive layer is provided on the lower side.

In the cutting unit 40, a pair of conveyor rollers 43 and 44 are provided on a discharge side of the sheet 21 in addition to the pair of blades 41 and 42. The heat-sensitive adhesive sheet 21 is carried to the thermally activating unit 50 at a posterior stage thereof while being sandwiched between the conveyor roller 43 and 44. Note that the heat-sensitive adhesive sheet 21 may be carried from the cutting unit 40 to the thermally activating unit 50 by utilizing sheet conveying force by the printing unit 30 without providing the conveyor rollers 43 and 44.

Moreover, in this printer apparatus, detectors S1 and S2 such as photosensors, which detect the existence of the sheet 21 before an entrance of the printing unit 30 and before the thermal head 51 of the thermally activating unit 50, are provided.

Figure 2:
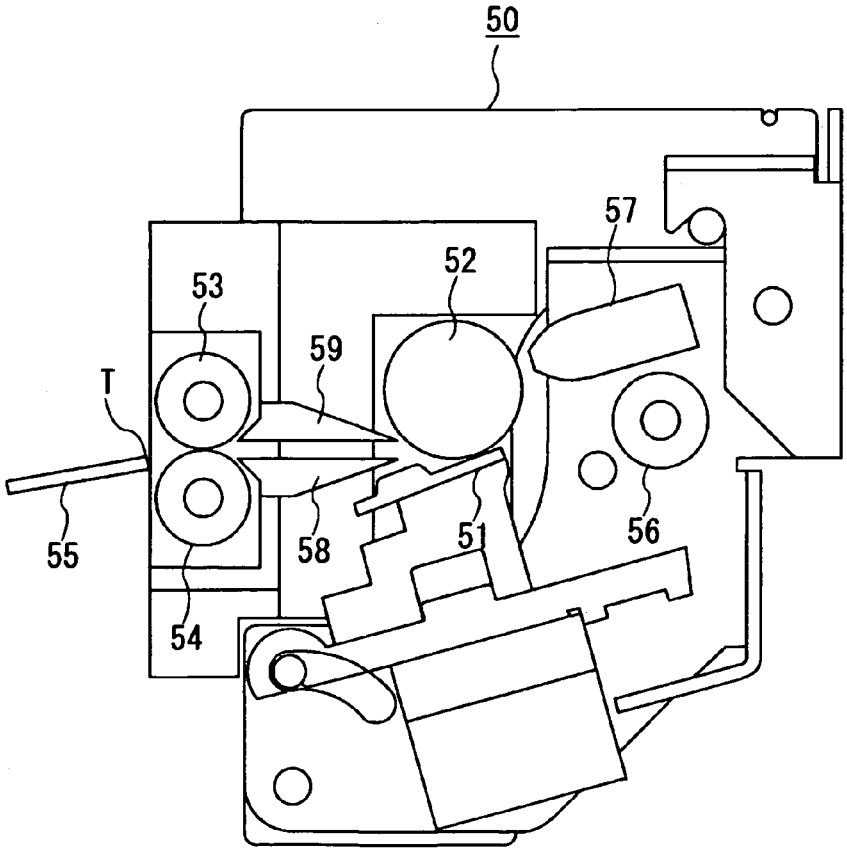
FIG. 2 is an internal side view showing a thermally activating unit of FIG. 1 in detail.

FIG. 2 shows a detailed internal side view of the thermally activating unit 50.

In the thermally activating unit 50, there are provided the thermal head 51 as a heater section composed by forming a large number of heat generating elements on a substrate in a line, and the platen roller 52 which presses the heat-sensitive adhesive sheet 21 to these heat generating elements. Besides, in an insertion portion (receiving portion, conveying means) which receives the heat-sensitive adhesive sheet 21 from the device of the anterior stage, there is provided a carrying-in section comprised of an insertion guide 55 as a guide member which abuts on one surface side of the sheet 21 and guides a path of the sheet 21, and a pair of insertion rollers (conveyor rollers) 53 and 54 which carry in the carried heat-sensitive adhesive sheet 21 into the unit while sandwiching the sheet 21 therebetween. This pair of insertion rollers 53 and 54 are rotationally driven by driving means such as a stepping motor (not shown).

Moreover, a lower guide 58 and an upper guide 59 which guide the sheet to the thermal head 51 are provided between the insertion rollers 53 and 54 and the thermal head 51. Furthermore, a discharge roller 56 and a discharge guide 57 which discharge the sheet 21 to the outside are provided at a posterior stage of the thermal head 51.

According to the printer apparatus with the above-described configuration, while the heat-sensitive adhesive sheet 21 is being carried from the printing unit 30 to the thermally activating unit 50, the printing process in the printing unit 30, the cutting process into the predetermined length in the cutting unit 40, and the activating process of the adhesive layer in the thermally activating unit 50 are continuously performed, and the heat-sensitive adhesive sheet 21 which has been subjected to the processes is sequentially discharged to the outside.

Then, during such processes, control is performed such that an insertion speed of the sheet 21 in the thermally activating unit 50 becomes slower than a carrying-out speed of the sheet 21 in the cutting unit 40. Thus, as shown in FIG. 1, the heat-sensitive adhesive sheet 21 bends between the cutting unit 40 and the thermally activating unit 50 and swells or curls toward one surface side. Here, a direction of a curve of the swelling or curling portion becomes the same as a curling direction of the heat-sensitive adhesive sheet 21.

Figure 3:
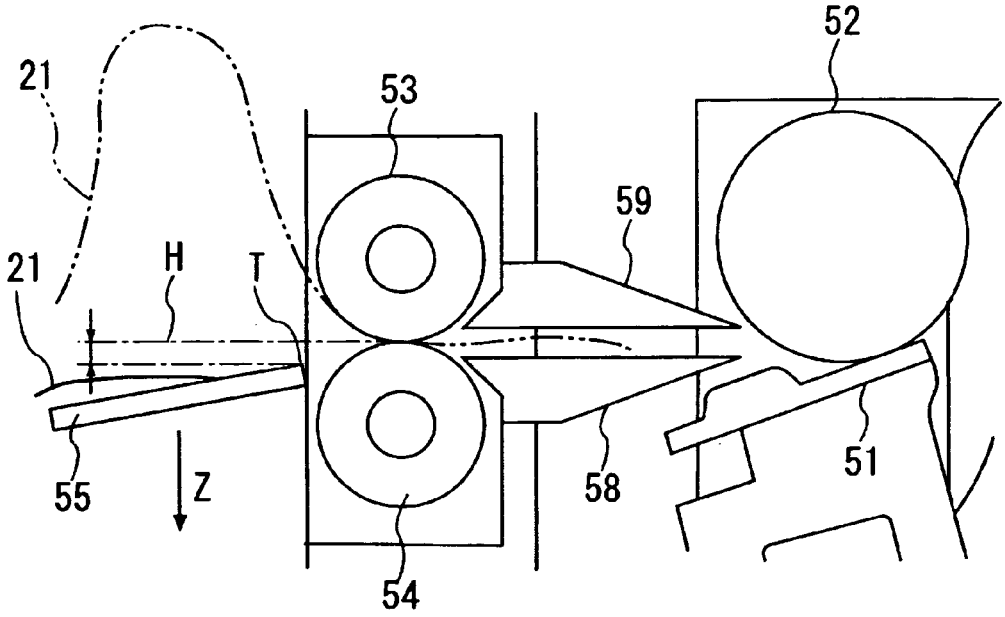
FIG. 3 is a view explaining how a heat-sensitive adhesive sheet is conveyed in an insertion portion of the thermally activating unit of FIG. 2.

FIG. 3 is a view explaining a detailed configuration of the insertion portion of the thermally activating unit 50 and how the heat-sensitive adhesive sheet 21 is conveyed therethrough.

In the thermally activating unit 50 of this embodiment, as shown in FIG. 3, when viewed in an axial direction of the insertion rollers 53 and 54, a tip end T of the insertion guide 55 of the thermally activating unit 50 is arranged to be offset in a direction Z opposite to a side toward which the sheet 21 bends and swells from a reference line H which is a tangential line of the insertion rollers 53 and 54 and passes through a contact point of the pair of insertion rollers 53 and 54. Moreover, an inclination is provided such that a distance between a guide surface and the reference line H is shortened as the guide surface approaches the insertion rollers 53 and 54.

With such a configuration of the insertion guide 55, when the tip end of the heat-sensitive adhesive sheet 21 which is cut by the cutting unit 40 and remains curled is carried into the insertion portion of the thermally activating unit 50, the tip end of the sheet 21 smoothly enters between the insertion rollers 53 and 54, thus making it possible to lower the jam occurrence frequency at this region.

Figure 4:
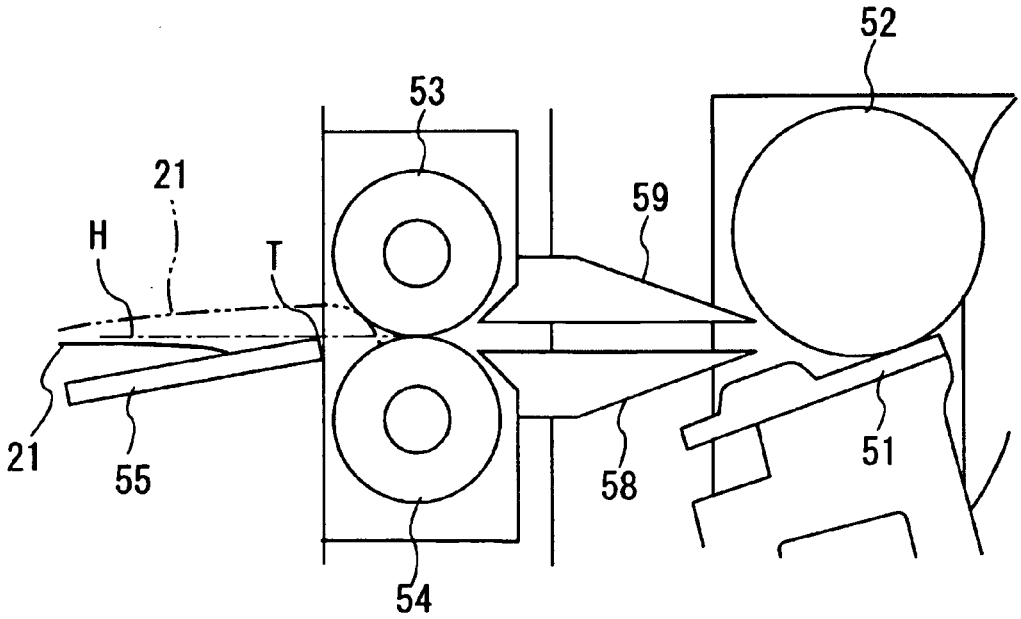
FIG. 4 is a view explaining how the sheet is conveyed when an offset of an insertion guide is set at "0" for a comparison.

As a comparison, FIG. 4 is a view explaining a configuration in which the offset of the insertion guide 55 is eliminated and the guide tip end T thereof is set at the same height as the reference line H, and explaining how the heat-sensitive adhesive sheet 21 is conveyed.

In the configuration as shown in FIG. 4, in which the offset of the insertion guide 55 is eliminated, the heat-sensitive adhesive sheet 21 extending along the insertion guide 55 abuts on the insertion roller on the lower side owing to the curling. Meanwhile, before the leading end of the sheet 21 enters between the conveyor rollers 53 and 54, a curled surface slightly before the tip end abuts on the insertion roller 53 on the upper side (refer to the sheet 21 shown by a two-dotted line of FIG. 4). Then, a force to push the leading end of the sheet 21 downward is applied from the insertion roller 53 to the leading end of the sheet 21, and this force reacts on a force to allow the leading end of the sheet 21 to enter into a center between the insertion rollers 53 and 54. Accordingly, the jam occurs at a certain frequency.

On the other hand, as shown in FIG. 3, by offsetting the insertion guide 55 downward, even when the curled surface slightly before the leading end of the sheet 21 abuts on the insertion roller 53 on the upper side, the leading end of the sheet 21 has already entered between the insertion rollers 53 and 54 or has advanced to a position slightly before the insertion rollers 53 and 54, and has been brought into a state where the force which reacts on an advancing direction thereof does not occur. As a result, the jam occurrence frequency is significantly lowered.

Moreover, the guide surface of the insertion guide 55 is inclined so that the distance between the guide surface and the reference line H is shortened as the guide surface approaches the insertion rollers 53 and 54. Thus, even when the curled surface slightly before the leading end of the sheet 21 abuts on the insertion roller 53 at a relatively early stage, an angle of the abutment is approximated to a horizontal direction than to a downward direction. Hence, a force to hinder the leading end of the sheet 21 from advancing does not occur very much, and the leading end of the sheet 21 is made to smoothly enter between the pair of insertion rollers 53 and 54.

An arrangement and angle of the insertion guide 55, which can significantly lower the jam occurrence rate, are described below in detail.

Figure 5:
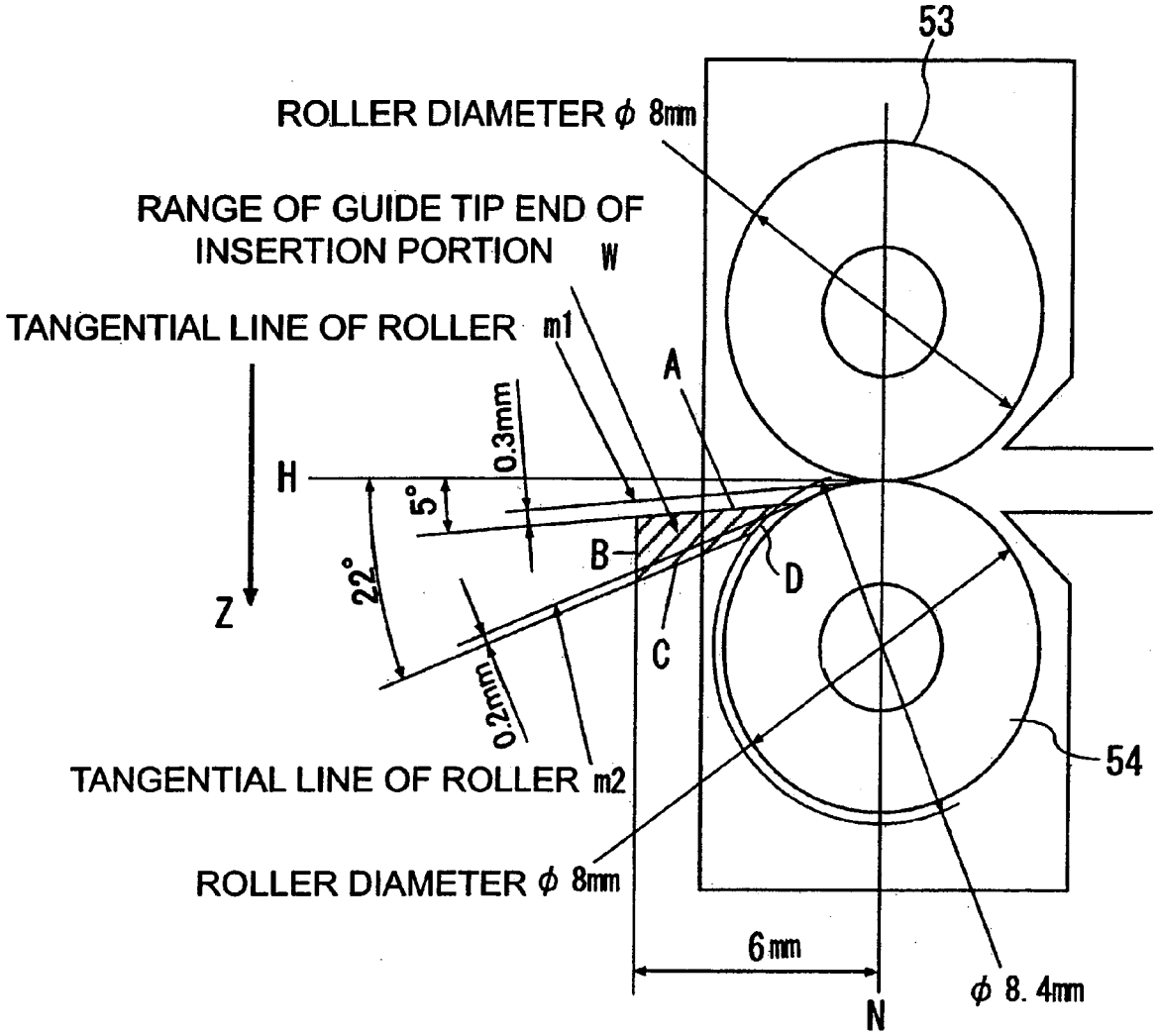
FIG. 5 is a view explaining a range of an optimum position of a tip end of the insertion guide.
Figure 6:
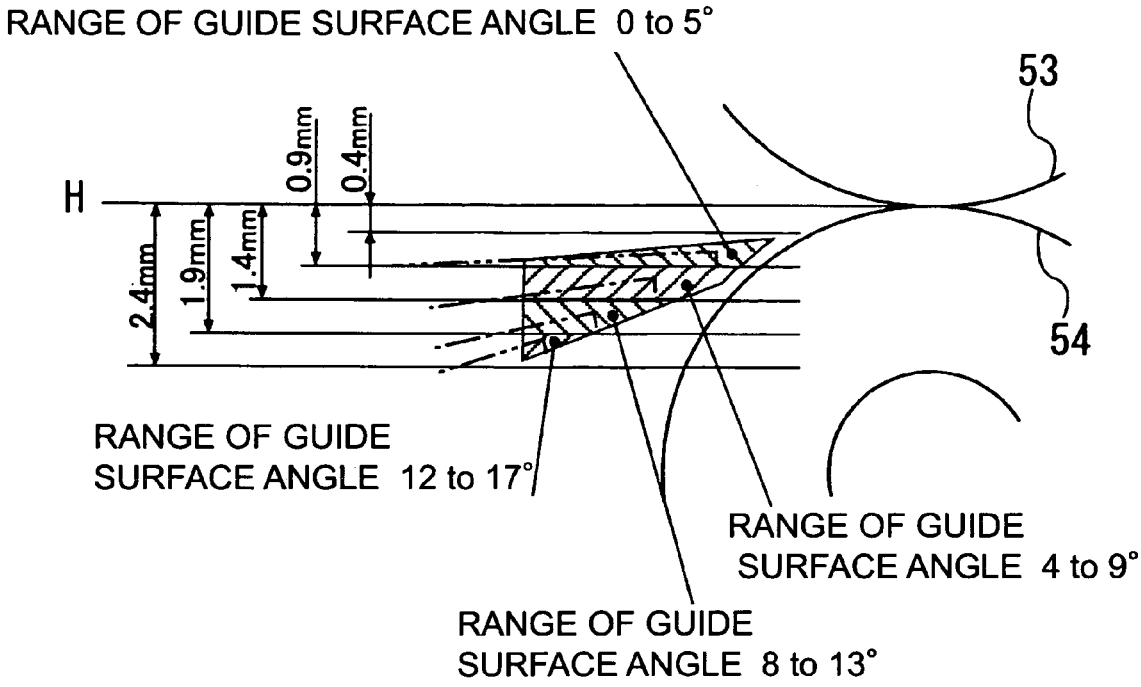
FIG. 6 is a view explaining a range of an optimum inclination angle of the insertion guide.

FIG. 5 is a view explaining a range of the optimum position of the tip end of the insertion guide 55, and FIG. 6 is a view explaining a range of the optimum inclination angle of the insertion guide 55.

The arrangement of the insertion guide 55 with respect to the insertion rollers 53 and 54 is made such that the tip end T of the guide is located within a range W of FIG. 5 when viewed from the axial direction of the insertion rollers 53 and 54. Thus, the jam occurrence rate is significantly lowered, which has been confirmed from an experiment.

Here, the range W is a range surrounded by the following straight lines A, B and C and circular arc D.

Straight line A: a straight line which is parallel to a tangential line m1 of the insertion roller 54, the tangential line m1 having an inclination of 5° with respect to the reference line H, and which is apart from this tangential line m1 by 0.3 mm to a Z side;

Straight line B: a straight line which is parallel to a line segment N connecting respective rotation center points of the two insertion rollers 53 and 54, and is apart from this line segment N by 6 mm;

Straight line C: a straight line which is parallel to a tangential line m2 of the insertion roller 54, the tangential line m2 having an inclination of 22° with respect to the reference line H, and which is apart from this tangential line m2 by 0.2 mm to the Z side; and Circular arc D: an arc of a circle which is concentric with the insertion roller 54, and of which diameter is longer than that of the insertion roller 54 by 0.4 mm.

Moreover, as shown by two-dotted lines in FIG. 6, the inclination of the guide surface of the insertion guide 55 is set so as to be small when the insertion guide 55 is near the reference line H, and to be large when the insertion guide 55 is separated from the reference line H. Thus, the jam occurrence rate is significantly lowered, which has been confirmed by experiment.

Specifically, recommended inclinations of the guide surface are as follows: 0° to 5° when the guide tip end T is within a range of 0.4 to 0.9 mm from the reference line H; 4° to 9° when the guide tip end T is within a range of 0.9 to 1.4 mm from the reference line H; 8° to 13° when the guide tip end T is within a range of 1.4 to 1.9 mm from the reference line H; and 12° to 17° when the guide tip end T is within a range of 1.9 to 2.4 mm from the reference line H.

As described above, such arrangement and inclination are given to the insertion guide 55, thus making it possible to significantly lower the jam occurrence frequency at the insertion portion while considering ease of installation of the insertion guide 55.

Note that the present invention is not limited to the above-described embodiment, and various alterations are possible. For example, the range W within which the guide tip end T is arranged, the range having been shown in the embodiment, is a range where the jam occurrence frequency is significantly lowered, and the arrangement of the guide tip end T is not limited to this range W. For example, even if the range is set as one surrounded by, in place of the straight line B, a straight line B2 apart from the line segment N of FIG. 5 by 10 mm, and even if the range is set as one surrounded by, in place of the straight line C, a straight line C2 apart from the straight line m2 by 0.5 mm to the Z side, it is possible to lower the jam occurrence frequency.

Moreover, in the above-described embodiment, an example has been described where the configuration of the guide according to the present invention is applied to the insertion portion of the thermally activating unit. However, besides the above, if, between two conveyor rollers, there is a region where the tip end of the heat-sensitive adhesive sheet is made to enter and is conveyed, it is possible to apply the configuration of the guide according to the present invention before the region.

Furthermore, the configuration of the guide according to the present invention is applied not only to the configuration for guiding and conveying the heat-sensitive adhesive sheet, but can also be applied to a mechanism for conveying, for example, a sheet curled in a fixed orientation, such as roll paper.

This invention can be applied to a thermally activating device which activates an adhesive layer of a heat-sensitive adhesive sheet, a printer apparatus including this thermally activating device and a printing device which performs printing on a printing surface of the heat-sensitive adhesive sheet, and a printer apparatus which performs printing and output by use of heat-sensitive roll paper.

What is claimed is:

1. A thermally activating device, comprising:

a carrying-in section into which a heat-sensitive sheet is carried from a device at an anterior stage; and a heater section for heating the carried heat-sensitive adhesive sheet while conveying the heat-sensitive adhesive sheet;

wherein the thermally activating device bends the heat-sensitive sheet toward one surface side thereof in a region between the carrying-in section and the device at the anterior stage by changing between a speed at which the heat-sensitive adhesive sheet is carried out of the device at the anterior stage and a carrying-in speed thereof in the carrying-in section;

wherein the carrying-in section comprises a pair of conveyor rollers that convey the heat-sensitive adhesive sheet while sandwiching the heat-sensitive adhesive sheet therebetween; and a guide member provided at an anterior stage of the pair of conveyor rollers for abutting on one surface of the heat-sensitive adhesive sheet to guide a path of the heat-sensitive adhesive sheet;

wherein a guide tip end nearest the conveyor rollers on a guide surface of the guide member is disposed at a position displaced from a reference line in a direction opposite to a side toward which the heat-sensitive adhesive sheet bends when viewed from a rotation axis direction of the conveyor rollers, the reference line being a tangential line of the conveyor rollers and passing through a contact point of the pair of conveyor rollers; and wherein the guide tip end is displaced from the reference line by a length of R×0.05 to R×0.3, where R is a diameter of the conveyor roller on a side to which the guide tip end is displaced, an inclination at a portion of the guide tip end of the guide surface is set at 0° to 17° with respect to the reference line, and the guide tip end is disposed at a position spaced apart by R×0.25 to R×0.75 from a plane including respective rotation axis lines of the pair of conveyor rollers.

2. A printer apparatus, comprising:

conveying means for conveying a sheet which is drawn from roll paper and curled in a fixed orientation; and a printing mechanism which has a line thermal head and performs printing on the sheet by the line thermal head;

wherein the conveying means comprises a pair of conveyor rollers that convey the sheet while sandwiching the sheet therebetween; and a guide member provided at an anterior stage of the pair of conveyor rollers for abutting on one surface of the sheet to guide a path of the sheet;

wherein a guide tip end nearest the conveyor rollers on a guide surface of the guide member is disposed at a position displaced from a reference line in a direction opposite to a side toward which the sheet bends owing to the curling when viewed from a rotation axis direction of the conveyor rollers, the reference line being a tangential line of the conveyor rollers and passing through a contact point of the pair of conveyor rollers;

wherein the guide surface of the guide member is inclined so that a distance between the guide surface and the reference line is shortened in a part nearer the conveyor rollers; and wherein the guide tip end is displaced from the reference line by a length of R×0.05 to R×0.3, where R is a diameter of the conveyor roller on a side to which the guide tip end is displaced, an inclination at a portion of the guide tip end of the guide surface is set at 0° to 17° with respect to the reference line, and the guide tip end is disposed at a position spaced apart by R×0.25 to R×0.75 from a plane including respective rotation axis lines of the pair of conveyor rollers.

3. A printer apparatus, comprising:

conveying means for conveying a sheet which is drawn from roll paper and curled in a fixed orientation; and a printing mechanism which has a line thermal head and performs printing on the sheet by the line thermal head;

wherein the conveying means comprises a pair of conveyor rollers that convey the sheet while sandwiching the sheet therebetween; and a guide member provided at an anterior stage of the pair of conveyor rollers for abutting on one surface of the sheet to guide a path of the sheet;

wherein a guide tip end nearest the conveyor rollers on a guide surface of the guide member is disposed at a position displaced from a reference line in a direction opposite to a side toward which the sheet bends owing to the curling when viewed from a rotation axis direction of the conveyor rollers, the reference line being a tangential line of the conveyor rollers and passing through a contact point of the pair of conveyor rollers; and wherein the guide tip end is displaced from the reference line by a length of R×0.05 to R×0.3, where R is a diameter of the conveyor roller on a side to which the guide tip end is displaced, an inclination at a portion of the guide tip end of the guide surface is set at 0° to 17° with respect to the reference line, and the guide tip end is disposed at a position spaced apart by R×0.25 to R×0.75 from a plane including respective rotation axis lines of the pair of conveyor rollers.

4. In a printer apparatus having a pair of rotatable conveyor rollers that sandwich therebetween and convey a sheet drawn from a roll paper and curled in a fixed curling direction, and a printing mechanism that prints on the sheet: a guide member disposed ahead of the conveyor rollers for guiding the sheet between the conveyor rollers, the guide member having on a guide surface thereof a guide tip end that is disposed at a position displaced from a reference line in a direction opposite to the curling direction of the sheet when viewed from a rotation axis direction of the conveyor rollers, the reference line being a tangential line of the conveyor rollers and passing through a contact point of the conveyor rollers and, the guide tip end being displaced from the reference line by a length of R×0.05 to R×0.3, where R is a diameter of the conveyor roller on a side to which the guide tip end is displaced.

5. A printer apparatus according to claim 4; wherein the guide member is disposed below the reference line.

6. A printer apparatus according to claim 4; wherein the guide surface of the guide member is inclined downwardly from the guide tip end in a direction away from the conveyor rollers.

7. A printer apparatus according to claim 4; wherein the guide tip end of the guide member is nearer to the reference line than any other part of the guide member.

8. A printer apparatus according to claim 4; wherein the guide member is fixed in position relative to the reference line.

9. A printer apparatus according to claim 4; wherein the guide tip end of the guide member is fixed in position relative to the reference line.

* * * * *